US005448972A

United States Patent [19]

Paut

[11] Patent Number: 5,448,972

[45] Date of Patent: Sep. 12, 1995

[54] INTERNAL COMBUSTION ENGINE

[76] Inventor: Drazen Paut, Ul. Iv. Gundulica 28, Split, Croatia, 58000

[21] Appl. No.: 255,738

[22] Filed: Jun. 7, 1994

[30] Foreign Application Priority Data

Jun. 7, 1993 [HR] Croatia ..... P930950A

[51] Int. Cl.[6] ..... F02B 75/32

[52] U.S. Cl. ..... 123/62; 123/63

[58] Field of Search ..... 123/61 R, 62, 66, 63, 123/68, 55.2, 55.4, 55.5, 55.6, 55.7, 53.6, 197.3, 197.4

[56] References Cited

U.S. PATENT DOCUMENTS 2,472,647 6/1949 Covins ..... 123/62
3,878,821 4/1975 White ..... 123/61 R
4,485,769 12/1984 Carson ..... 123/63
5,341,774 8/1994 Erickson ..... 123/61 R
5,347,960 9/1994 Tokumi ..... 123/63

*Primary Examiner*—Marguerite Macy
*Attorney, Agent, or Firm*—Jacobson, Price, Holman & Stern

[57] ABSTRACT

In an internal combustion engine comprising an engine block housing at least one reciprocating piston being provided in a cylinder comprising at least one inlet valve and an exhaust valve, which piston is coupled with a crankshaft being coupled with a drive and/or working shaft, there is at least one two-sided piston reciprocating in two coaxial chambers each of a cylinder. Each chamber is provided on opposite sides of the crankshaft, wherein the at least one two-sided piston comprises a central bearing, through which the crankshaft is passing, and wherein the drive and/or working shaft is coupled eccentrically with the crankshaft.

10 Claims, 3 Drawing Sheets

INTERNAL COMBUSTION ENGINE

FIELD OF THE INVENTION

The present invention relates to an internal combustion engine comprising an engine block housing at least one reciprocating piston being provided in a cylinder comprising at least one inlet valve and an exhaust valve, which piston is coupled with a crankshaft being coupled with a drive and/or working shaft.

Branches of technology that the invention refers to:

Automobile/Car Industry

Aviation

Shipbuilding

Stationary drive of generators, compressors, etc.

Compressors

DESCRIPTION OF THE PRIOR ART

The existent internal combustion engines operate as single-acting engines, which means that the working substance or fuel is supplied to the cylinder only from one side, while the kinetic energy is transmitted from the piston further through the piston rod to the crankshaft also only from one side. Such known internal combustion engines, therefore, comprise a plurality of parts of which a great percentage is movable so that there exists a great wear on these numerous components.

SUMMARY OF THE INVENTION

It is therefore an object of the present invention to simplify the mode of transformation of the translational motion of the two-sided piston into the rotational motion of the crankshaft of an internal combustion engine.

It is a further object of the present invention to provide an internal combustion engine comprising fewer components and allowing a smaller and more lightweight structure in comparison with known internal combustion engines.

For solving these problems there is provided an internal combustion engine comprising an engine block housing, at least one reciprocating piston being provided in a cylinder comprising at least one suction valve and an exhaust valve, which piston is coupled with a crankshaft being coupled with a drive and/or working shaft, wherein at least one two-sided piston is reciprocating in two coaxial chambers each of a cylinder, each chamber being provided on opposite sides of the crankshaft, wherein the at least one two-sided piston comprises a central bearing, through which the crankshaft is passing, and wherein the drive and/or working shaft is coupled eccentrically with the crankshaft.

As different from the existent internal combustion engines, the internal combustion engine according to the present invention operates in a double acting manner, because the fuel is supplied from both sides of the two-sided piston, that has a bearing in the middle, through which the crankshaft passes. The crankshaft is bearing-mounted in the driving and working shafts that have the same eccentric as the crankshaft. While moving, the two-sided piston pushes the crankshaft which rotates around its axis in the piston bearing, and with its eccentric journals it pushes (turns around) the driving shaft and the working shaft that delivers the power by means of the fly-wheel to the consumer.

The cylinders of the internal combustion engine according to the present invention may comprise also a spark plug besides the respective valves if constructed as a gasoline engines or it is provided only with an injection system in case of a Diesel engine. As a matter of fact there may also be provided more than one inlet and/or exhaust valves as is known from prior constructions as there may also be provided an additional injection system even for gasoline engines.

According to a preferred embodiment of the present invention there is provided an internal combustion engine, wherein a connecting part connecting the two piston heads of the two-sided piston comprises an opening, which houses an eccentric part of the crankshaft, and wherein the cylinder is provided with two concentric openings functioning as bearings for the working and/or drive shaft. The essence of the invention is in the fact that there is provided a double-action piston through which a crankshaft passes that transforms a linear motion of the piston into a rotary motion of the driving shaft and the working shaft. Advantageously, the two-sided piston is built in one piece and wherein the corresponding parts of the crankshaft are fitted into both sides of the opening of the connecting part of the two-sided piston.

The driving shaft may serve to drive the auxiliary equipment of the engine (camshaft, oil pump, water pump, etc.), while the working shaft conveys power through the fly-wheel to the consumer according to a further preferred embodiment of the present invention.

Such design renders possible smaller overall dimensions (reductions of up to 40%) of the engine for the same working volume, smaller weight (reductions of up to 50%) of the engine, and a smaller number of the component parts. The inventive design of the piston guarantees longer life of the piston and the cylinder owing to a greater contact surface of the piston which delivers the normal power to the cylinder. Further advantages are that this can be used for manufacturing of engines of the existent technological standard, and that it does not require special machines or tools.

When starting an engine comprising at least one two-sided piston cooperating with a crankshaft the crankshaft may reach a position where the piston remains in in its place and the engine is blocked and cannot be started. For avoiding such a dead-center position the crankshaft is provided with a tooth or projection cooperating with a corresponding recess in the engine block according to a further preferred embodiment of the present invention. The tooth or projection provided on the crankshaft and also the corresponding recess in the engine block, whose equation is an ellipse equation, together shall move the crankshaft from the centre of the engine in the longitudinal direction of the cylinder and also the piston with it and prevent the crankshaft and the piston from reaching the dead-center position blocking the engine. The tooth and the recess of the engine block are meshing like the teeth of two gear wheels.

The internal combustion engine according to the present invention can be carried out in 3 ways:

Four-stroke engine;

Two-stroke engine by using a compressor;

by using one chamber as a working chamber, and the other as a compressor;

Compressor: one- or multi-stage compressor, with certain modifications in design.

Therefore, with a four-stroke engine according to a further embodiment of the present invention both chambers of the two-sided piston are provided with at least one inlet valve and at least one exhaust valve. According to an alternative embodiment of the present invention for constructing a two-stroke engine with a compressor one chamber of the two-sided piston is provided with at least one inlet valve and at least one exhaust valve, whereas the other chamber is working as a compressor.

It has to be pointed out that the piston stroke is four times greater than the eccentricity performed at the crankshaft and the working shaft.

Further advantages are that the existing technology can be used for manufacturing this engine, and that it does not require any special machines or tools. For a leightweight construction the engine block and the cylinders and the piston can be made of aluminium according to a further preferred embodiment.

A fewer number of component parts in relation to the classic-type lies in the fact that there is not necessary any piston rod, any piston pin or pin lock, and that a smaller number of bearings is required. The inventive internal combustion engine comprises fewer moving masses and therefore reducing the vibrations of the engine.

These savings are greater in engines with more cylinders. According to a preferred embodiment of the internal combustion engine at least two two-sided pistons are arranged side by side, being coupled with a common crankshaft for providing a multiple-cylinder engine. According to a simple and easy construction there is provided a one-piece crankshaft.

SHORT DESCRIPTION OF THE DRAWINGS

These and other characteristic features will become appearent from the following description of preferred, nonlimiting examples of embodiments of the internal combustion engine according to the present invention being shown in the attached drawings, wherein:

FIG. 1 is a sectional view of a first embodiment of an internal combustion engine according to the present invention, FIG. 2 shows schematical representations of further embodiments of the internal combustion engine according to the present invention comprising a plurality of cylinders, wherein in FIG. 2*a* there is provided a one-piece crankshaft, whereas in FIG. 2*b* there is provided a divided crankshaft; and FIGS. 3*a*–3*f* shows a kinetic analysis of different stages of the movement of a two-sided piston of the internal combustion engine according to the present invention.

DETAILED DESCRIPTION OF THE PREFERRED EMBODIMENTS

Figure 1:
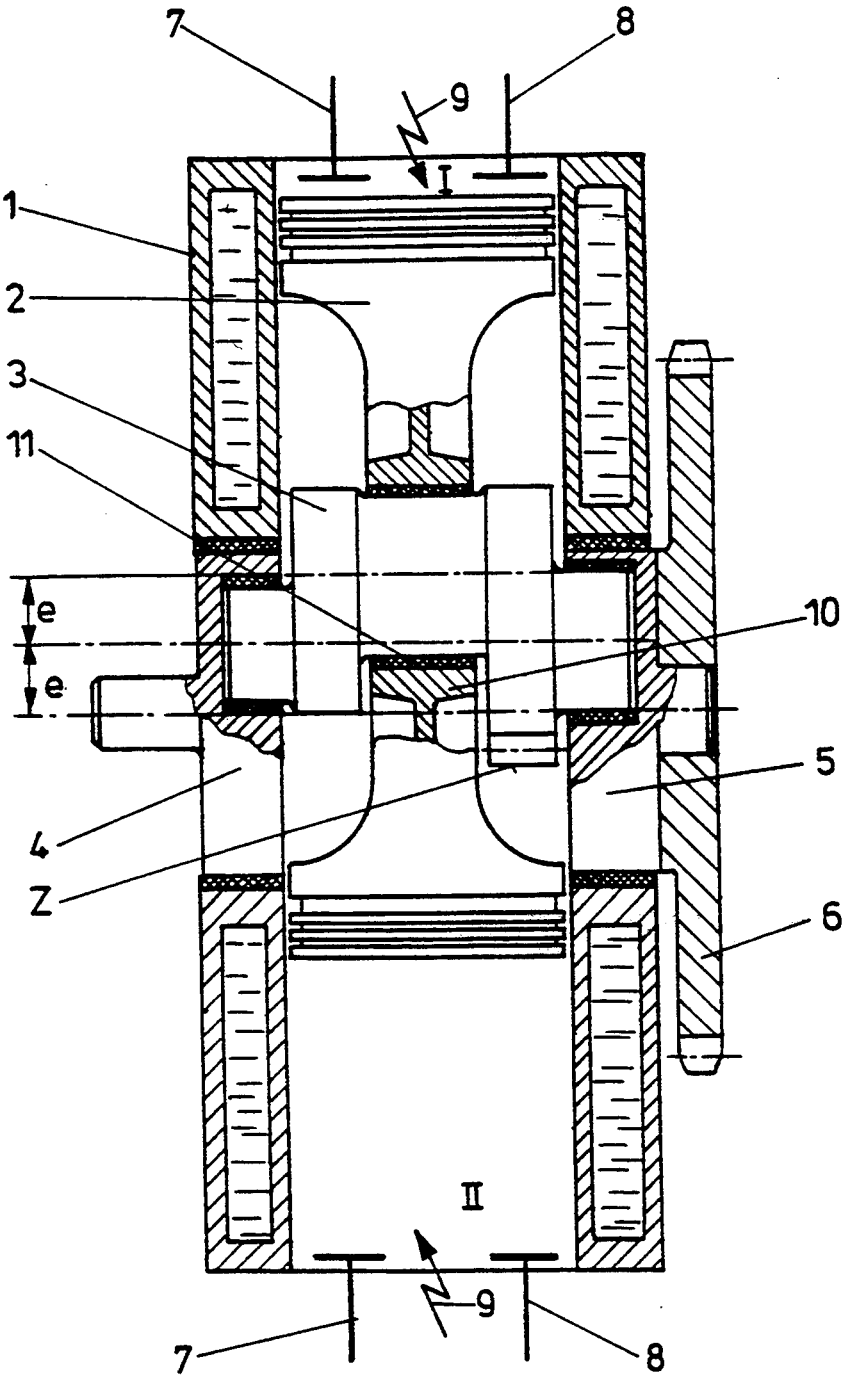

The FIG. 1 shows a first embodiment of an internal combustion engine with all the essential component parts:

1—Engine block
2—Two-sided piston
3—Crankshaft
4—Driving shaft
5—working shaft
6—Fly-wheel
7—Inlet valve
8—Exhaust valve
9—Spark plug
I and II—Chambers of the cylinder
Z—Tooth on the crankshaft
Black fields denote bearings.

FIG. 1 shows a one cylinder engine with one double-sided piston 2 and two chambers I and II of the cylinder. From the drawing there can be seen a connection 10 of the two-sided piston 2 with a bearing, defined by an opening 11 in the middle, through which a crankshaft 3 passes, which in turn is bearing-mounted in the working and driving shafts 4, 5 with the same eccentricity e as the crankshaft 3 in the bearing 11 of the connecting part 10 of the two-sided piston 2.

Figure 3A:
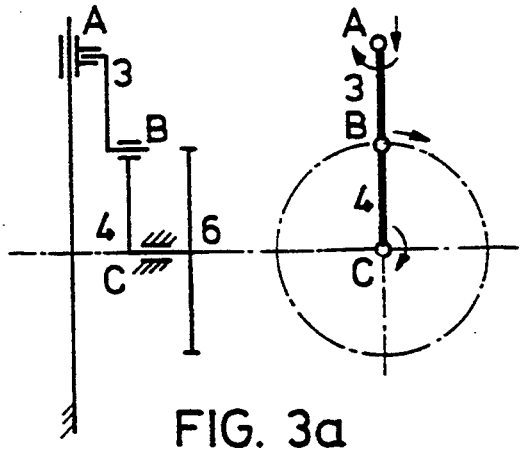
Figure 3B:
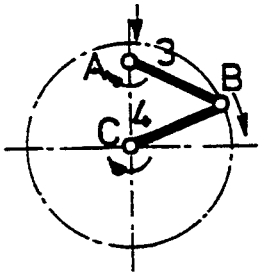
Figure 3C:
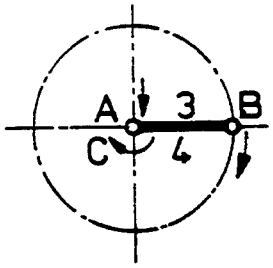
Figure 3D:
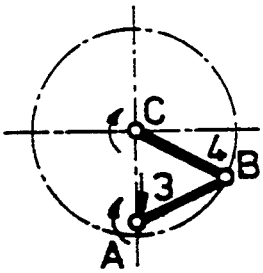
Figure 3E:
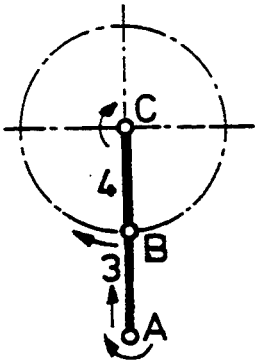
Figure 3F:
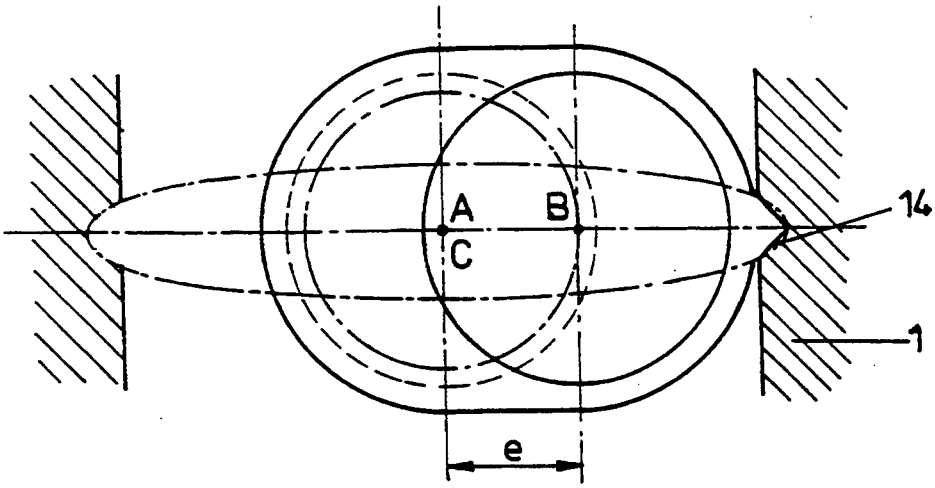

For easy reference, in FIG. 1 there is no drawing indication of the recess that corresponds to the tooth Z, but the recess is shown in the FIG. 3*f*.

The driving shaft 4 transmits the power to the auxiliary equipment of the engine (oil pump, alternating current generator, camshaft, etc.), while the working shaft 5 transmits power further to the consumer (automobile, compressor, power generator unit, etc.). This equipment, which is known per se, is not shown in the drawings.

Figure 2A:
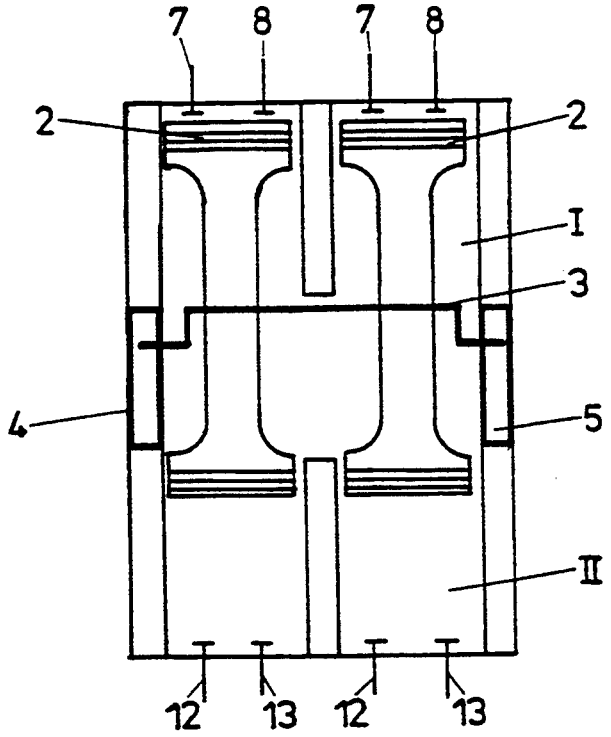

Depending on the design, a two-sided piston 2 can be made from one part, taking into account, that the crankshaft 3 is constructed as a two-part one, as is schematically shown by the dotted line in FIG. 1. Alternatively the two-sided piston 2 may be made in two parts, while the crankshaft 3 is made in one part, as is schematically shown in FIG. 2*a*. It is also possible to make the engine block 1 in one part or in two parts.

A possibility for making multi-cylinder engines is shown in principle in FIG. 2.

The FIG. 2*a* shows an engine with two cylinders, two two-sided pistons 2 and therefore four combustion chambers I and II for each cylinder, as well as linkage of pistons 2 through a one-piece crankshaft 3 to the driving and working shafts 4 and 5. This form of the crankshaft 3 is suitable for a two-cylinder engine.

Figure 2B:
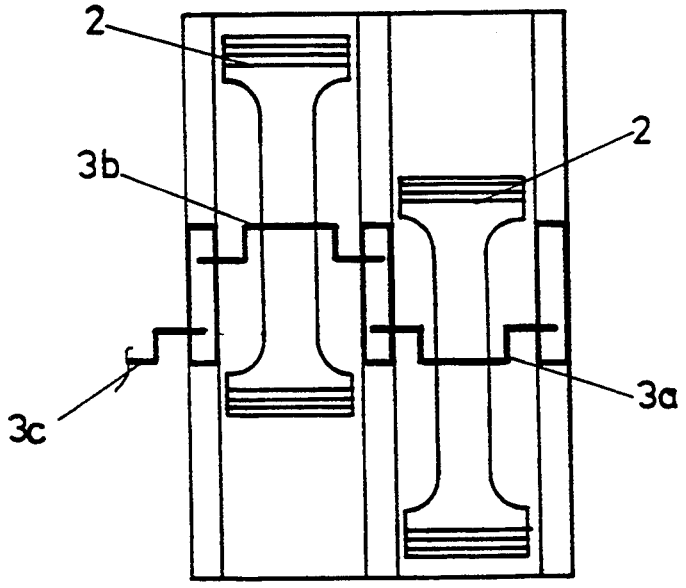

The FIG. 2*b* shows a possibility for making 2-, 3-, 4 . . . -cylinder engines and the principle of mutual connection of pistons 2, a divided crankshaft 3*a*, 3*b*, driving and working shafts 4 and 5. This design is especially interesting for multiple-cylinder engines, because the two-sided cylinders 2 working in opposite directions minimize the vibrations of the engine and allow a compensation of the energy of the moving masses, i.e. the moving two-sided pistons 2. As is schematically shown by a further part 3*c* of the crank shaft, it is possible with such design to combine any desired number of cylinders.

FIG. 3 shows the kinematic analysis of different stages of the movement of the mechanism of an embodiment of the internal combustion engine.

Points:

A—Center of the two-sided piston 2, connection of the piston 2 with the crankshaft 3

B—Eccentric connection of the crankshaft 3 and working shaft 5;

C—Center of the engine 1 and of the working shaft 5.

Members:

3—Crankshaft
5—Working shaft
6—Fly-wheel

The FIG. 3 shows a kinematic scheme of the mechanism as a lay-out plan of the mechanism and of the paths of some members and points of the mechanism for the stroke of the two-sided piston 2 of 4*e* (e=eccentricity) and turning of the working shaft and/or the driving shaft 4, 5 for 180°. When the engine is started and the two-sided piston 2 comes to the position as shown in the FIG. 3*c*, one can see that the point B has turned around its axis along with the parts 3 and 5, i.e. together with the crankshaft 3 and the working shaft 5, while the piston 2 remained in its place. In order to avoid this blocking condition of the two-sided piston 2 when starting the engine, a tooth or projection Z is provided on the crankshaft 3 (see FIG. 1 and FIG. 3*f*) and also a corresponding recess 14 in the engine block 1, wherein equation of the movement of the tooth Z of the crankshaft 3 is an ellipse equation (FIG. 3*f*) taking into account the eccentricity e of the connection between the opening 11 of the connecting part of the two-sided piston 2 with the crankshaft 3 and the eccentric connection between the crankshaft 3 and the working and drive shafts 4, 5. The combination of the tooth or projection Z of the crankshaft 3 and the corresponding recess 14 in the engine block 1, which mesh like teeth of gear wheels or pinions, shall throw out the crankshaft 3 in the longitudinal direction of the movement of the two-sided piston 2 from the centre of the engine and also the piston 2 with it. The recesses 14 (FIG. 3*f*) can be made directly in the engine block or as special segments to be affixed to the block.

When the engine works this problem of a blocking of a movement of the two-sided piston 2 cannot appear, because the piston 2 puts the mechanism into motion.

The construction of the internal combustion engine can be carried out in 3 ways:

Four-stroke engine;

Two-stroke engine by using a compressor;

by using one chamber as a working chamber, and the other as a compressor;

Compressor: one- or multi-stage compressor, with certain modifications in design.

In FIG. 2*a* there is shown a four-stroke engine, wherein there are only provided one inlet valve 7 and one exhaust valve 8 in the chambers I of the cylinders, whereas the cheers II are provided with an inlet valve 12 and an exhaust valve 13 each. Such engine is constructed as a Diesel engine, wherein the inlet valves may be connected with injection systems, which are not shown in the drawing.

The construction shown in FIG. 2*a* may also be constructed as an engine by using a compressor wherein the chambers II of the cylinders are the compressor part and the valves 12 and 13 are the inlet and outlet valves of the compressor. Analogously the structure of FIG. 2*a* may be constructed as a multi-stage compressor with a corresponding arrangement of the valves.

The technical innovation of the internal combustion engine according to the present invention in relation to known internal combustion engines lies in the fact, that the construction is more congested (for the same working volume); it has a smaller number of component parts (no piston rods, no pin pins, no pin locks, a smaller number of bearings); the moving masses are greatly reduced; it works as a double acting engine; and the manufacturing is simpler.

It has to be pointed out that the piston stroke is four times greater than the eccentricity e performed at the crankshaft 3, and the working and driving shafts 4, 5. Further advantages are that the existing technology can be used for manufacturing this engine, and that it does not require any special machines or tools.

The internal combustion engine according to the present invention has a different kinematics of operation in relation to the existent internal combustion engines. Namely, the connection of the essential elements 2 to 5 that transform a translational movement of a two-sided piston 2 into a rotational movement of the working crankshaft 3 consists in the following.

The two-sided piston 2 has a bearing 11 in the middle, through which passes the crankshaft 3 that is bearing the driving and working shafts 4 and 5 having the same eccentricity e as the crankshaft 3. When the piston 2 moves, it pushes the crankshaft 3 around its axis in the piston bearing 11, while it pushes (turns) the driving and the working shafts 4 and 5 with its eccentricity e (FIG. 1), which deliver power to the consumer. In order to make it impossible for the two-sided piston 2 to stop in the middle of the engine, it is necessary to make a tooth or projection Z on the crankshaft 3 that, along with the corresponding recesses 14 in the engine block 1, push the piston 2 from the middle of the engine (FIG. 3*f*). By means of linking more one-cylinder units one gets multi-cylinder engines (FIGS. 2*a* and *b*).

The internal combustion engine has such a kinematic mode of operation (FIG. 3), that the two-sided piston 2 pushes, through the bearing 11 in the center of the two-sided piston 2, the crankshaft 3 that moves the working shaft 5 and the driving shaft 4.

I claim:

1. Internal combustion engine comprising an engine block housing at least one reciprocating piston being provided in a cylinder comprising at least one inlet valve and an exhaust valve, which piston is coupled with a crankshaft being coupled with a drive and/or working shaft, wherein at least one two-sided piston is reciprocating in two coaxial chambers each of a cylinder, each chamber being provided on opposite sides of the crankshaft, wherein the at least one two-sided piston comprises a central bearing, through which the crankshaft is passing, and wherein the drive and/or working shaft is coupled eccentrically with the crankshaft.

2. Internal combustion engine according to claim 1, wherein a connecting part connecting the two piston heads of the two-sided piston comprises an opening, which houses an eccentric part of the crankshaft, and wherein the cylinder is provided with two concentric openings functioning as bearings for the working and/or drive shaft.

3. Internal combustion engine according to claim 2, wherein the two-sided piston is built in one piece and wherein the corresponding parts of the crankshaft are fitted into both sides of the opening of the connecting part of the two-sided piston.

4. Internal combustion engine according to claim 1 wherein the crankshaft is provided with a tooth or projection cooperating with a corresponding recess in the engine block.

5. Internal combustion engine according to claim 1, wherein both chambers of the two-sided piston are provided with at least one inlet valve and at least one exhaust valve.

6. Internal combustion engine according to claim 1, wherein one chamber of the two-sided piston is provided with at least one inlet valve and at least one exhaust valve, whereas the other chamber is working as a compressor.

7. Internal combustion engine according to claim 1, wherein the crankshaft is coupled on one end with a drive shaft serving for driving auxiliary equipment of the engine, such as the camshaft, oil pump, water pump, etc., and wherein the crankshaft is coupled on the other end with a working shaft conveying power through a fly-wheel to a consumer.

8. Internal combustion engine according to claim 1, wherein at least two two-sided pistons are arranged side by side, being coupled with a common crankshaft.

9. Internal combustion engine according to claim 8, wherein there is provided a one-piece crankshaft.

10. Internal combustion engine according to claim 1, wherein the engine block and the cylinders and the piston are made of aluminium.

* * * * *